United States Patent [19]

Brinkmann et al.

[11] Patent Number: 4,629,341

[45] Date of Patent: Dec. 16, 1986

[54] METHOD FOR CONTROLLING PRINTING POSITION ON A TYPEWRITER FOR UNDERLINING

[75] Inventors: Gerhard Brinkmann, Schortens; Claus Bordasch, Wilhelmshaven, both of Fed. Rep. of Germany

[73] Assignee: Olympia Aktiengesellschaft, Wilhelmshaven, Fed. Rep. of Germany

[21] Appl. No.: 704,560

[22] Filed: Feb. 22, 1985

[30] Foreign Application Priority Data

Mar. 30, 1984 [DE] Fed. Rep. of Germany ..... 3411849

[51] Int. Cl.[4] ..... B41J 29/32

[52] U.S. Cl. ..... 400/17; 400/76

[58] Field of Search ..... 400/16, 17, 18, 19, 400/20, 21, 22, 76

[56] References Cited

U.S. PATENT DOCUMENTS 4,392,758 7/1983 Bowles ..... 400/17 X

OTHER PUBLICATIONS

IBM Technical Disclosure Bulletin, vol. 21, No. 6, Nov. 1978, pp. 2392–2393, "Printing Underscore Characters and Storing Representations Thereof" by Franklin.

IBM Technical Disclosure Bulletin, vol. 22, No. 6, Nov. 1979, pp. 2330–2332, "Multiple Underscore Logic for Typewriters" by Buchanan et al.

IBM Technical Disclosure Bulletin, vol. 26, No. 8, Jan. 1984, p. 4374, "Optimization of Underscoring and Overstriking Operations in Word-Processing Printers" by Daniels et al.

*Primary Examiner*—Charles Pearson

*Attorney, Agent, or Firm*—Wood, Herron & Evans

[57] ABSTRACT

For underlining a text section a command is typed both before and after the text section in the typing sequence, which command causes the storing of position values in two registers. The underlining is then performed underneath the already entered characters. A command for line advance, facultatively in connection with returning the printing head to a left position, ensures that the underlining will be performed prior to the line advance, but that the conditions for the underline will be retained also for the next line.

5 Claims, 5 Drawing Figures

FIG. 1
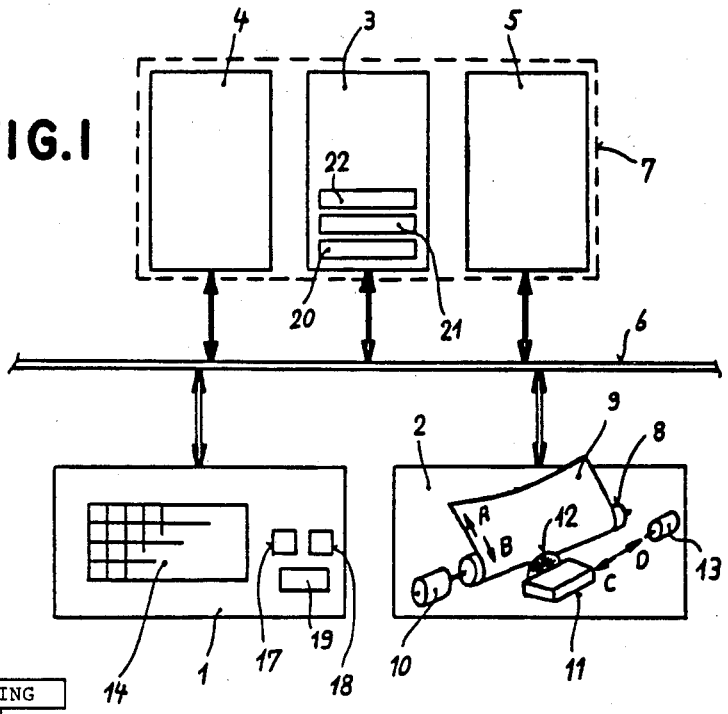
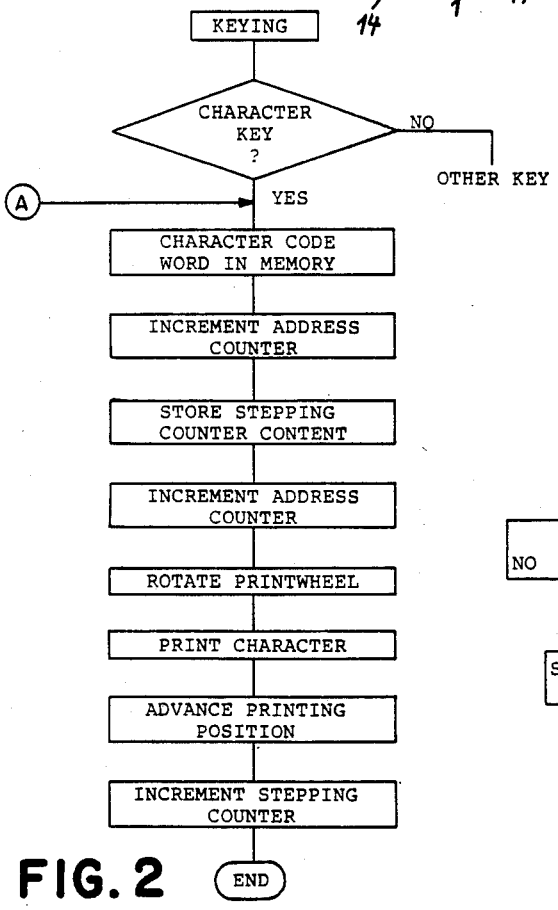
FIG. 2
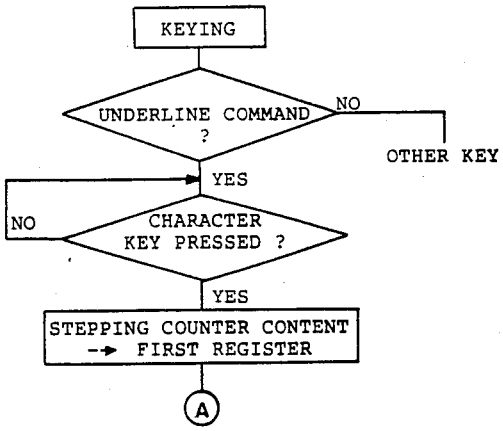
FIG. 3

METHOD FOR CONTROLLING PRINTING POSITION ON A TYPEWRITER FOR UNDERLINING

BACKGROUND OF THE INVENTION

This invention relates to typewriters and similar machines and is particularly directed to a method for automatically underlining a text section whose characters can be stored in a memory, where the beginning of the text section to be underlined is marked by entering an underline command, and the underlining is performed by entry of an underline end command between the underlining beginning and ending marks.

One of the requirements an operator of a typewriter or similar machine must handle is underlining defined areas of a typed text without hindering in so doing a swift typing of characters, but where the underlining of a typed text section must not be postponed because the operator would otherwise be required to make a note of this area, return the printing head to the beginning position of this area, and manually type repeatedly underlining.

To meet this requirement it has been suggested, e.g., in U.S. Pat. No. 4,392,758, to automatically underline the respective text section upon entering two commands marking the beginning and end of the text section which is contained in between and must be underlined. For that purpose, the operator presses, during typing, a first command key at the beginning of the area to be underlined, continues typing at normal speed, and presses a second command key at the end of the area to be underlined. The characters entered (and/or codes representing these characters) are stored in a line memory and the two commands marking the section to be underlined are stored as special codes between the characters in typing sequence. Each of the typed characters and also the underline command codes are then stored in memory exactly in the sequence in which they will be printed on the paper by the printer of the machine.

Entering the second underline command at the end of the section to be underlined additionally causes the memory content to be searched in reverse direction until the beginning code for the underlining area is found among the stored characters. Next, every character located to the right of the code is automatically underlined until the ending code is found in memory. This solution presupposes a rigid order of the stored characters in the same way they appear on the paper. But the rigidity of such storing is often undesirable, among other things, because then it is necessary to occupy memory locations for any spacing steps, tabulating jumps, etc.

The problem underlying the invention is providing a method of the initially-mentioned type for underlining defined text sections where the typing speed of the operator of a machine so equipped is not impeded, but where no memory with fixed positional allocations is required.

SUMMARY OF THE INVENTION

In accordance with the present invention, this problem is solved by providing a method for controlling the typing position including the steps of storing, after entry of an underline command, in a first register the horizontal position of the next character to be typed in the current text, storing after the entry of an underline end command the horizontal position of the character typed at the last position within the current text, setting the typing position to one of the stored horizontal positions, producing underlining by automatic stepwise advance of the printing position to the other stored horizontal position and, thereafter, setting the printing position to the horizontal position following the underlining.

The advantages of the invention are constituted by the fact that the layout of the character memory and thus of the entire processor control of the machine is not hindered or forced to assume certain forms by the provision of an underlining function which does not entail operating problems. The control sequences for the various machine functions related with the typing and storage of characters may be conceived in accordance with requirements of their own when using the inventional solution, independent of the underlining function.

Other objects and advantages of the present invention will be more readily apparent from a consideration of the following detailed description of the drawings illustrating a preferred embodiment of the invention.

BRIEF DESCRIPTION OF THE DRAWINGS

FIG. 1 shows a block diagram of a typewriter embodying the present invention.

FIG. 2–5 show flow charts.

DESCRIPTION OF A PREFERRED EMBODIMENT

Figure 4:
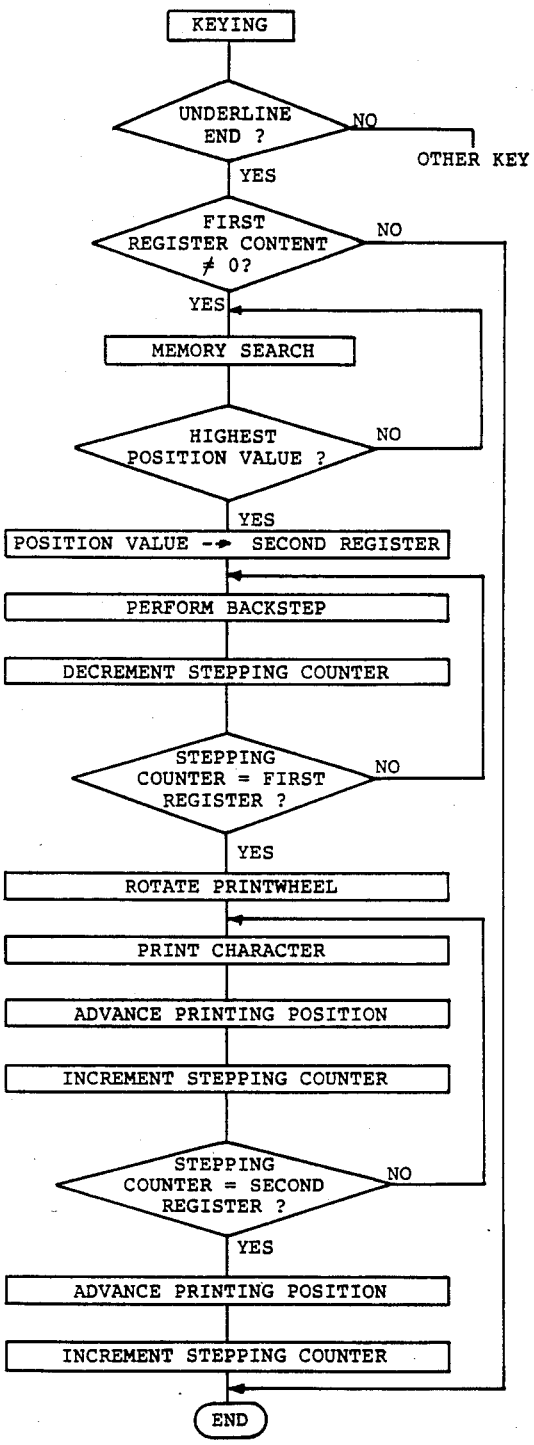

Presented in FIG. 1, the block diagram of a typewriter embodying the present invention comprises for greater clarity only the elements necessary for understanding the invention. These are a keyboard 1, a printing unit 2, and a control unit 3 with a program memory 4 and data memory 5 connecting with each other through a bus 6. The control unit 3, program memory 4, and data memory 5 are an integral part of the microprocessor control 7 of the machine, for which reason the functions of all modules mentioned hereafter, for instance, counters and registers, which participate in the control can basically be realized by program sequences.

Among other things, the printing unit 2 comprises a platen 8 which in customary fashion can stepwise advance, in vertical direction (arrow A, B), a recording medium 9. The drive is provided by a motor 10 which can be activated stepwise. Featuring a rotatable print wheel 12 as character carrier, the printing head 11 is moved horizontally by another stepping motor 13 (direction of arrows C, D). The horizontal positioning of the printing head 11 and the respective setting of the print wheel 12 for the character to be printed makes it possible to print the characters of a text line side-by-side on the recording medium 9, while through vertical positioning of the recording medium 9 line advances are performed for arranging text lines one below the other.

In addition to the character field 14 for the character input, the keyboard 1 features various function keys, of which only a key 17 for entering the underline command, a key 18 for entering an underline end command, and a key 19 for entering a line advance command (facultatively connected with a command for resetting the printing head 11 to the left-hand home position) are illustrated here. All of the function commands may also be entered in customary fashion through jointly pressing a code key together with a specific key of the character keyboard field, without providing separate command keys.

Figure 5:
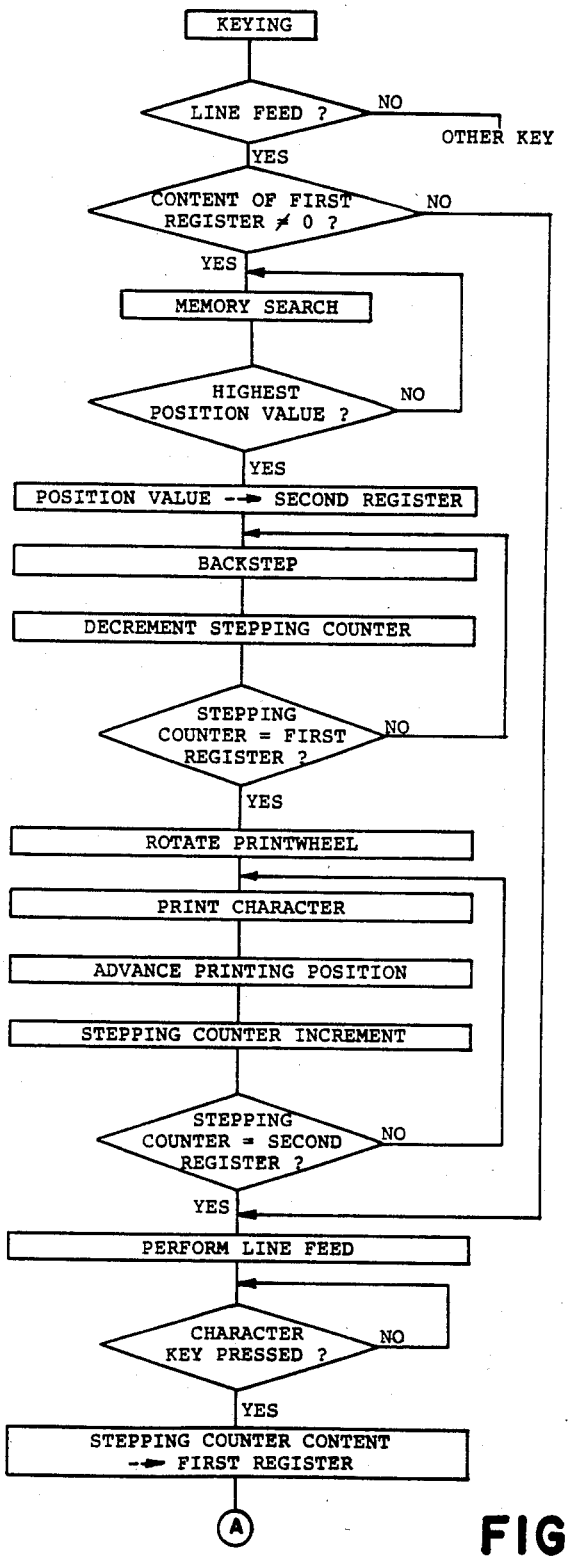

The inventional function sequence will be explained hereafter with the aid of the flow charts in FIGS. 2, 3, 4 and 5. A scan of the keyboard 1 determines whether a key has been pressed and which key is concerned. If, as shown in FIG. 2, a character key has been pressed in the character keyboard section 14, a character code derived from the keyboard signal and representing the character is entered in the data memory 5 under control by the control unit 3. The memory location in which the character code is stored is accessed as usual by way of an address provided by an incrementing and decrementing address counter in the control unit 3. The address counter increments upon storing the character code so that the next storage location in the data memory 5 will be accessed.

The microprocessor control 7 utilizes a stepping counter 20 whose counting function is coupled with the stepping movement of the printing head 11. For each step performed by the printing head 11 and/or the motor 13 powering it, the stepping count is incremented (direction of movement D) or decremented (direction of movement C). Thus, the stepping counter 20 always represents the actual position of the printing head 11 along the typing lines.

A step of the printing head 11 and/or an incrementing or decrementing step of the stepping counter 20 is not required to correspond with a column step of the pitch of the printed text. Without departing from the present invention, such column step may as well consist of several elemental steps performed by the motor 14. Such a subdivision is necessary, e.g., to enable the typewriter to reproduce a text with proportional character spacing, or for inserting characters between column steps. In the case of elemental step subdivision, a column step consisting of several elemental steps would thus be performed after each character impression, and the step counter would be incremented by a corresponding number of steps. In order not to complicate understanding, however, the following description will be based on only one step per character spacing.

Following the character code word storing in the data memory 5 as described above, the position contained in the stepping counter 20 is stored in the next accessible storage location, and the address counter is incremented again. The control unit 3 then transmits the appropriate activation signals to the printer 11 through which the print wheel 12 is set for the character to be imprinted, whereafter the character is printed. Another activation instruction of the control unit 3 to the printing unit 2 causes the motor 13 to move the printing head 11 one column step in the direction of arrow D. At the same time, the stepping counter 20 is incremented so that it will contain the new position of the printing head.

If the keybord scan, upon pressing key 17, determines an underline command according to FIG. 3 and a character key in the keyboard section 14 is pressed, the actual stepping counter content coinciding with pressing the character key is stored in a first register 21 of the microprocessor control 7. The further sequence corresponds then with the representation in FIG. 2, comprising the character code storage in the data memory 5, storing the stepping counter content (corresponding with the horizontal position of the printing head 11) in the data memory 5, setting and printing the character and stepping to the next column position along with incrementing the stepping counter 20.

When the keyboard scan discovers an underline end command entered through pressing key 18, the first register 21 is tested as to whether its content is $\neq 0$ (i.e., whether the beginning of a text section to be underlined was marked). If yes, the control unit 3 initiates a memory search for the largest positional value for a stored character in the data memory 5. This positional value is stored in a second register 22 and the motor 13 is activated by the control unit 3 to move the printing head 11 backward b one column step. At the same time, the stepping counter 20 is decremented. Next, the stepping counter content is compared with the positional value stored in the first register 21. If they are in disagreement, the backstepping, stepping counter decrementing, and comparison continue until both values are in agreement.

At that point, the print wheel 12 moves the underline character in printing position and the character is printed. The motor 13 is activated to move the printing head 11 one step in typing direction (i.e., forward), and the stepping counter 20 is again incremented. The stepping counter content is compared with the positional value contained in the second register 22. If they are unequal, the underline character is printed again, a column step in typing direction is performed, and the stepping counter 20 is incremented. The process is repeated until the stepping counter content equals the position value stored in the second register 22. As the result of the comparison becomes positive, the control of the printing unit 2 causes the printing head 11 to move one additional column step forward in typing direction without printing any character. The stepping counter 20 is incremented, and the print head is now in the next unprinted column position behind the underlined text section.

If the keyboard scan reveals that a line shift, facultatively connected with a printing head 11 return to the left starting position, was entered by pressing the function key 19, a test is also conducted to determine whether the content of the first register 21 is $\neq 0$. If yes, the control sequence with the memory search and the subsequent steps continues as described in FIG. 4, but a line advance (and facultatively a return of the printing head to the left starting position) is conducted as soon as the position value in the second register 22 corresponds upon underlining with the stepping counter content. As soon as a character key of the character keyboard section 14 is then pressed in the new line, the value contained in the first register 21, from the previous line, is cancelled and replaced by the actual content of the stepping counter 20 as the first character of the new line is printed. The further functional sequence for the character impression proceeds then again as described in FIG. 2.

Although in the exemplary embodiment the printing head 11 is moved first to the left position of an area to be underlined and the actual underlining is then performed in a movement to the right, it is readily conceivable that the underlining may be conducted also beginning with the position value contained in the second register 22, proceeding to the left, moving the printing head 11 then, upon completion, to the right to the first blank position behind the underlined area. The exemplary embodiment presupposes that the printing head 11 prints the characters on the recording medium 9 immediately upon typing the character. Without changing anything on the invention, it is possible, however, to type initially only into the data memory 5 without immediate printing, in which case a checking may be provided for, if necessary, by means of a display. The stepping counter 20 will then not contain the actual position of the printing head 11; it rather counts the typing positions of the successively entered characters in the same way as they would have been input with simultaneous printing by the printing head 11. The described underlining process would then be performed internally by the control unit 3 in the data memory 5 so that the printing head 11 would perform the described sequence in a subsequent printing of the text.

If the machine is designed for proportionate printing, that is, for printing the characters with a column spacing coordinated with the respective character width, the highest position of a stored character as detected in the search operation is suitably so corrected in accordance with the step width value pertaining to the respective character, by a computation performed in the control unit 3, that the last underline segment printed at the end of the text area to be underlined will not extend unduly beyond the last character. That is, the last underline segment will with a narrow character overlap the previous underline section, since the underline character is invariable in width. The character width value is contained, e.g., in a table from which it is derived for controlling the stepping movement of the printing head 11 in accordance with the typed character and for controlling the stepping counter 20 for counting a corresponding amount, but from which it can be derived also for making the underline correction as described above.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims.

Having described our invention, we claim:

1. A method for controlling the typing position of a processor-controlled typewriter or similar machine for automatically underlining a text section whose characters can be stored in a memory where the beginning of the text section to be underlined is marked by entering an underline command and the end of said text section is marked by entering an underline end command, said underlining being performed upon entry of said underline end command, said method comprising the steps of:

storing, after the entry of an underline command, in a first register the horizontal position of the next character to be typed in the current text;

activating a memory search after the entry of an underline end command, said memory search searching for the last character typed in the current text, and upon finding the last character, storing its horizontal position in a second register;

setting the typing position to one of the stored horizontal positions;

producing underlining by automatic stepwise advance of the printing position to the other stored horizontal position;

and setting the printing position to the horizontal position following the underlining.

2. The method of claim 1 in which in continuous typing the horizontal position is counted by a stepping counter and stored in coordination with the respective characters, in that the horizontal position of the first character typed after entering the underline command is stored both in a memory and said first register, and that the memory search function searches for the highest horizontal position stored and stores it also in the second register.

3. The method of claim 1 in which after an underline end command the printing position is set to the horizontal position stored in the first register and the underlining is produced under stepwise advance to the horizontal position stored in the second register, and that the printing position is advanced to the next horizontal position in printing direction.

4. The method of claim 1 in which after an underline end command the printing position is set to the horizontal position stored in said second register and the underlining is produced under stepwise advance to the horizontal position stored in said first register, the printing position being advanced in printing direction by the difference between said first and second registers positions increased by one horizontal position.

5. The method of claim 1 in which upon typing a line feed function the horizontal position of the character typed at the last position of the current text is stored in said second register, the printing position is set to one of the horizontal positions stored in the first or second registers, the underlining is produced under stepwise advance to the other horizontal position, and upon performing the line feed the content of said first register is cancelled and the horizontal position of the first character to be printed in the next line is stored in said first register.

* * * * *